United States Patent [19]

Bogner et al.

[11] Patent Number: 5,007,657

[45] Date of Patent: Apr. 16, 1991

[54] LATERALLY RELEASABLE BINDING UNIT

[75] Inventors: Martin Bogner, Ostfildern; Otto Harsányi, Leonberg, both of Fed. Rep. of Germany; Henri Peyre, Saint Benin d'Azy, France

[73] Assignee: GEZE Sport International GmbH, Leonberg, Fed. Rep. of Germany

[21] Appl. No.: 375,783

[22] Filed: Jul. 5, 1989

[30] Foreign Application Priority Data

Jul. 28, 1988 [DE] Fed. Rep. of Germany ..... 3825682

[51] Int. Cl.[5] ..... A63C 9/085

[52] U.S. Cl. ..... 280/626; 280/628; 280/636

[58] Field of Search ..... 280/623, 625, 626, 627, 280/628, 631, 634, 635, 636

[56] References Cited

U.S. PATENT DOCUMENTS

| | | | |
|---|---|---|---|
| 3,866,929 | 2/1975 | Lacroix | 280/626 |
| 3,976,308 | 8/1976 | Näpflin | 280/626 |
| 4,170,372 | 10/1979 | Salomon | 280/626 |

FOREIGN PATENT DOCUMENTS

| | | |
|---|---|---|
| 241360 | 3/1987 | European Pat. Off. . |
| 3720440 | 3/1989 | Fed. Rep. of Germany . |

*Primary Examiner*—Andres Kashnikow

*Assistant Examiner*—Richard Camby

*Attorney, Agent, or Firm*—Townsend and Townsend

[57] ABSTRACT

Laterally releasable binding unit for holding the front end of a ski boot (12) including a base part (30) mounted on the ski (22), a release spring arranged longitudinally on the ski and an integral sole clamp (29) having two limbs (14) and a hold down clamp (15). The base part is a carrier spigot vertically tiltably mounted about a transverse axis (36). The sole clamp is rotatably arranged on the upright carrier spigot. A draw rod (38) passes through a slide bore (37') in a ball guide (37) within the carrier spigot and abuts, via a support disc (39) secured to the draw rod at its rear, a substantially flat rear support surface (40) of the carrier spigot. The rear end of the release spring is braced against an abutment (42) fixed to the sole clamp and thus presses the abutment against the front support surface (31) of the carrier spigot. The rear support surface (40') of the carrier spigot and/or the preferably flat counter surface (39') of the support disc above the draw bar, and/or the front surface (31') of the carrier spigot and/or the preferably flat counter surface (42') of the abutment beneath the draw bar (38) are tilted relative to the perpendicular of the surface of the ski in such a way that within a predetermined vertical tilting region (a) of the hold down clamp the hold down force is significantly reduced relative to the normal release hold down force.

9 Claims, 1 Drawing Sheet

LATERALLY RELEASABLE BINDING UNIT

Figure 1:
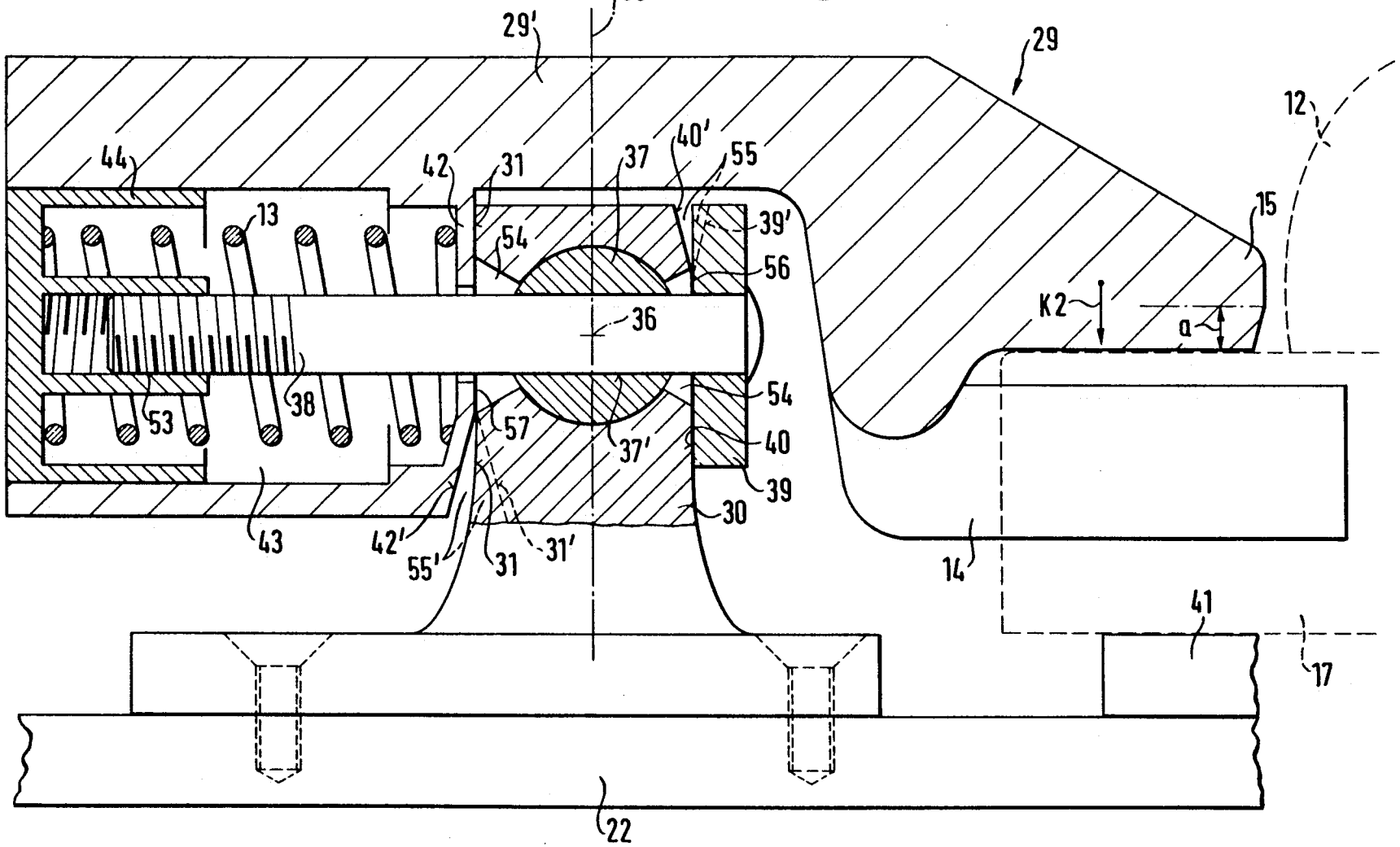

The invention relates to a laterally releasable binding unit, in particular the toe unit of a ski safety binding, for holding one end, preferably the front end of a ski boot, the binding unit comprising a base part fixed relative to the ski; and a release spring arranged substantially in the longitudinal direction of the ski, with the release spring being braced at one end on the base part and exerting at the other end a release force having a substantial component in the longitudinal direction of the ski on a sole clamp for the holding of the ski boot, with the sole clamp having either two limbs and a hold down clamp, or only two side limbs with a hold down function, in such a way that the side limbs, on exceeding a predetermined force exerted via the ski boot, swing outwardly sideways about a substantially upright pivot axis and release the ski boot.

Moreover, the release spring exerts a downwardly directed force component onto the hold down clamp or clamps which, together with the side limbs, is/are vertically tiltably arranged on the base part and is/are pressed by the downwardly directed force component against the top side of the sole of the ski boot.

The sole clamp is a single piece sole clamp having either two side limbs and a hold down clamp united with the side limbs or located therebetween, or having only two side limbs with a hold down function. In either case the single piece sole clamp is rotatably arranged on an upright carrier spigot mounted on the ski, with the carrying spigot representing the base part, and is vertically tiltably mounted about the transverse axis. A draw rod which passes through a slide bore in a ball guide within the carrier spigot contacts, by means of a support disc secured to it at the rear, against a substantially flat rear support surface of the carrier spigot, is led forwardly into a receiving chamber in the part of the sole hold down clamp remote from the ski boot, and is urged in the direction away from the ski boot by the front end of the release spring which is accommodated there, so that the support disc is pressed against the preferably flat rear support surface of the carrier spigot, and so that the rear end of the release spring is braced against an abutment fixed relative to the sole clamp and thus presses this abutment against the preferably flat front support surface of the carrier spigot.

In accordance with an older proposal (DE-OS 37 20 440) the laterally releasable binding unit is provided with tilting surfaces which are arranged on the side of the binding housing facing the ski boot on both sides of the vertical central longitudinal plane, with these tilting surfaces being provided with straight line tilt axes which extend substantially perpendicular to the ski surface and extend parallel to one another in a straight line. Complementary counter tilting surfaces provided on the side of the sole clamp facing away from the ski boot act on the tilting surfaces and the action of the release force is such that when excessive lateral forces are applied to the ski boot the sole clamp pivots outwardly against the force of the release spring and frees the ski boot.

In this arrangement the invention of the older proposal envisages that the release spring exerts a slightly obliquely downwardly directed force onto the sole clamp and that an angle is present between the line of action of the release spring and the branch of each tilting axis which lies beneath it, with the angle being made smaller than 90° by an amount such that the force component acting downwardly on the sole clamp is able to displace the sole clamp downwardly along the tilting axes, until the hold down clamp contacts the upper side of the sole of the ski boot.

The present invention makes use of the inventive concept of the older proposal for laterally releasable binding units in accordance with EP-A-0 241 360 in which, on exceeding a predetermined lateral force exerted by the ski boot, the lateral limbs pivot outwardly and sideways about a substantially vertical pivot axis and release the ski boot. The generalized inventive concept in this can be seen in the fact that the release spring also exerts a downwardly directed force component on the hold down clamp which is vertically tiltably arranged on the binding housing about a transverse axis and which is pressed by the downwardly directed force components against the upper side of the sole of the ski boot.

Whereas the laterally releasable binding unit of DE-OS 37 20 440 only operates with one tilting jaw the object of the present invention is to apply the above defined inventive concept also to the laterally releasable binding unit of EP-A-0 241 360, without the realization requiring an excessive amount of complexity and expense and without the functional reliability of the binding unit being impaired.

In order to satisfy this object a laterally releasable binding unit of the initially named kind is further developed so that the rear support surface of the carrier spigot and/or the preferably flat counter surface of the support disc above the draw bar, and/or the front support surface of the carrier spigot and/or the preferably flat counter surface of the abutment beneath the draw bar are tilted relative to the perpendicular to the surface of the ski in such a way that within a predetermined vertical tilting region of the hold down clamp the hold down force is significantly reduced relative to the normal release hold down force.

In this manner it is possible, simply by a minor inclined arrangement of specific flat support surfaces, which are in any event present, to realize a reduced hold down force in a specific vertical pivoting range which makes it possible to insert ski boot soles of different thickness into the binding unit without adjustment of the sole clamp and without the clamping by the sole hold down clamp being substantially changed.

Further advantageous developments of this embodiment are characterized by the subordinate claims 2 to 8. The special advantage of all embodiments lies in the fact that an automatic adaption of the binding unit to various ski boot thicknesses can be effected simply by the provision of slightly inclined oblique surfaces.

The invention will now be described in the following by way of example and with reference to the drawing in which are shown:

FIG. 1 a partially section side view of an embodiment of a laterally releasable binding unit in accordance with the invention with a one piece sole clamp and combined lateral and vertical release.

As seen in FIG. 1 a sole hold down clamp 15 and two lateral limbs 14 are formed in one piece on a sole clamp 29, with the front end of the sole 17 of the ski boot 12 engaging between the lateral limbs 14 provided at the left and at the right and being pressed downwardly by the sole hold down clamp against a foot plate 41.

The sole clamp 29 extends from the hold down clamp 15 with the two lateral limbs 14 by means of a bridge part 29' forwardly over a central carrying spigot 30 secured to the ski 22 and contains the release spring 13 in its front portion within a release spring receiving chamber 43. The axis of the release spring is arranged in the longitudinal direction of the ski. At the front the release spring 13 is braced against an abutment 44 which is axially displaceably arranged inside the receiving chamber 43 and the abutment can be adjusted in the longitudinal direction of the ski by an adjusting nut 53 which is accessible from the front and which is screwed onto the front end of a horizontally arranged draw rod 38. The end of the draw rod 38 remote from the adjusting nut 53 extends through a central opening 54 of the carrying spigot 30 beyond the rear side of the carrying spigot 30 where the end of the draw rod 38 is connected with a substantially flat support disc 39 which extends perpendicular to the draw rod 38 in all radial directions relative to the axis of the draw rod 38. The central opening 54 of the carrying spigot 30 extends in the longitudinal direction of the ski and has conically broadened front and rear ends. The flat support disc 39 is preferably round and concentrically disposed relative to the draw rod 38. The draw rod 38 passes through the central bore 54 with clear play to all sides and is restrictedly pivotally movable and axially displaceably journalled in a ball guide 37 provided within the central part of the bore 54, with the ball guide having a central bore 37' forming a sliding seat for the draw rod 38.

It is for this purpose that the opening 54 has an outwardly diverging conical shape at its two ends as can be seen from FIG. 1. As a result of the ball guide 37 the draw rod 38 and thus also the sole clamp 29 is pivotable about a transverse axis 36 as also about a vertical axis 36'. Thus combination upward and side releases are also possible.

The rear end of the release spring 13 is supported via an abutment 42 which contacts the front support surface 31 of the carrying spigot 30 and which is fixedly connected with the bridge part 29' of the sole clamp 29 and preferably forms one piece therewith. In this way the sole clamp 29 is biased rearwardly by the release spring 13 and is supported from the rear through the carrying spigot 30 which is fixedly arranged on the ski. In accordance with European Application Publication No. EP-A-0 241 360 the front support surface 31 of the carrying spigot 30 and also the rear surface of the abutment 42 which is fixedly mounted on the sole clamp and the rear vertical support surface 40 of the carrying spigot 30 as well as the front surface of the support disc 39 extend perpendicular to the draw rod 38 so that the sole clamp 39 can pivot outwardly against the force of the spring 13, both in the vertical and in the lateral direction, and release the ski boot 12 when excessive vertical and/or side forces occur at the tip of the ski boot.

In accordance with the invention the rear vertical support surface 40 is now tilted forwardly above the draw rod 38—as seen in side view—at 40' through a small angle of for example 5°. In analogous manner, or simultaneously, the front surface of the support disc 39 can also be tilted somewhat rearwardly which is indicated in broken lines at 39'. In corresponding manner the front support surface 31 of the carrier spigot 30 can extend somewhat downwardly and rearwardly in the direction towards the ski boot in the manner indicated in broken lines at 31' beneath the draw rod 38—likewise as seen in side view—while the oppositely disposed surface 42' of the abutment 42 can be tilted slightly in corresponding manner in the opposite direction.

Having regard to the draw rod 38 there remain however, radially inside of the V-shaped upwardly and downwardly open gaps 55, 55' substantially planar support surfaces 56, 57 which extend perpendicular to the draw rod 38 and have a considerably reduced vertical extent. In this manner a vertical pivoting of the sole clamp 29 about the transverse axis 36 is made possible in a predetermined vertical range of movement "a" about the transverse axis 36 against a force which is substantially reduced relative to the vertical release force. Through the small radial extent of the support surfaces 56, 57 a relatively small hold down force component K2 can be generated on the sole clamp 29 without the safety release which takes place after exceeding the play "a" being impaired.

As soon as the range of movement "a" set by a inclination of the inclined surfaces 31',39', 40', 42', i.e. the range of movement with reduced hold down force is exceeded, then the normal vertical release force is again effective since then both the support disc 39 and also the abutment 42 have again braced against the carrying spigot 30 at the top and at the bottom but further radially outwardly, whereby the resistance against a vertical movement of the hold down clamp 15 is reduced in step-like manner. Within the range of movement "a" the sole clamp 29 can press with a defined force of for example 200 N onto the ski boot sole 17 from above whereas above the range of movement "a" the substantially larger normal vertical release force acts which is first exceeded on the presence of loadings which are dangerous for the ski's leg.

Thus, in accordance with the invention, the support surfaces which extend to the left and to the right of the draw rod 38 on the carrying spigot 30 or on the support disc 39 and on the abutment 42 are directed flatly and perpendicular to the axis of the draw rod 38, so that the lateral release is in no way impaired by the measures of the invention for generating a reduced hold down force.

In place of the lateral limbs 14 and the special sole hold down clamp 15 is also possible to use lateral limbs which extend obliquely to the longitudinal direction of the ski and which take on both the lateral support of and the holding down of the tip of the ski boot, such as is provided in the front binding unit of EP-A- 0 241 360.

We claim:

1. Laterally releasable ski safety binding unit for holding a front end of a ski boot on a ski, the binding unit comprising:

an upright carrier spigot fixed relative to the ski;

a release spring arranged substantially longitudinally on the ski and braced at one end on the carrier spigot, the other end exerting a release force having a substantial component in the longitudinal direction of the ski;

a sole clamp for holding the ski boot, the sole clamp having a receiving chamber remote from the ski boot for accommodating said release spring, and a limb configuration comprising one of (a) two side limbs and a hold down means comprising a clamp adjacent to said side limbs and (b) two side limbs and a hold down means, such that upon the release force exceeding a predetermined force exerted on the side limbs via the ski boot, said limbs swing outwardly sideways about a substantially upright pivot axis and thereby release the ski boot, the sole clamp being rotatably arranged on said carrier spigot mounted on the ski and vertically tiltably mounted about a transverse axis of the ski;

said release spring exerting a force having a downward component onto the hold down means to thereby press the hold down means with the force component against the top side of the sole of the ski boot;

a ball guide disposed within said carrier spigot and having a slide bore therein;

a draw rod passing through said slide bore;

a support disc secured to the rear of said draw rod against a substantially flat rear support surface of the carrier spigot, said support disc disposed between said draw rod and said carrier spigot and having a substantially flat counter surface in facing relationship with said rear support surface;

said draw rod extending into said receiving chamber and urged in the direction away from the ski boot by the front end of said release spring such that the support disc is pressed against said rear support surface;

the opposing, rear end of said release spring being braced against an abutment fixed relative to the sole clamp and having a substantially flat contact surface to thereby press said contact surface against a substantially flat front support surface of said carrier spigot;

the front and rear support surfaces of said carrier spigot and the counter and contact surfaces of the support disc and the abutment including cooperating tilted surface portions arranged to permit relative pivotal movements of said draw rod and thereby of said hold down means, about an axis transverse to the length of the ski such that within a predetermined vertical tilting region of the hold down means as a result of such pivotal movements, the hold down force is significantly reduced relative to the normal release hold down force.

2. Binding unit in accordance with claim 1, wherein said support disc comprises a support washer having a flat construction and extending perpendicular to an axis of the draw rod, wherein one of (a) the counter surface of the support washer provided above the draw rod being tilted towards the ski boot and (b) the support surface having a flat configuration and being tilted away from the ski boot.

3. Binding unit in accordance with claim 1, wherein the contact surface of the abutment facing the carrier spigot is substantially flat and is perpendicular to the axis of the draw rod, a part of the contact surface being located beneath the draw rod and tilted away from the ski boot forwardly, resulting in a flat oblique contact surface.

4. Binding unit in accordance with claim 1, wherein the front and rear support surfaces of the carrier spigot are substantially flat and perpendicular to the axis of the draw rod, a region of the support surfaces lying below the draw rod is tilted rearwardly towards the ski boot, the so formed surfaces being oblique and flat.

5. Binding unit in accordance with claim 1, wherein the support surfaces are flat and arranged perpendicular to the longitudinal axis of the draw rod, so that the side release is not influenced by the oblique surfaces.

6. Binding unit in accordance with claim 1, wherein the abutment includes substantially flat support surfaces extending perpendicular to the axis of the draw rod, and wherein oblique surfaces form V-shaped gaps radially inside of the V-shaped gaps broadening radially upwardly and downwardly respectively, with the radial extent of the support surfaces being just sufficiently large that in the desired vertical tolerance region a hold down force acts from above on the ski boot sole, the hold down force being substantially reduced relative to the vertical release force.

7. Binding unit in accordance with claim 1, wherein radially outwardly conically diverging bores are disposed forwardly and rearwardly of the ball guide, the diameter of those bores being substantially larger at each point that the outer diameter of the draw rod such that the ball guide permits restricted pivotal movement of the draw rod about the transverse axis and/or about the vertical axis relative to the carrying spigot.

8. Binding unit in accordance with claim 1, wherein the lateral limbs extend obliquely to the longitudinal direction of the ski outwardly; and wherein the side limbs simultaneously contact the sole of the ski boot from above and the upper of the ski boot obliquely from the front.

9. Binding unit in accordance with claim 1, wherein the front and rear support surfaces of the carrier spigot are substantially flat and perpendicular to the axis of the draw rod, a region of the support surfaces lying above the draw rod being tilted forwardly away from the ski boot, the so formed oblique surfaces being flat.

* * * * *